United States Patent [19]

Schmidt et al.

[11] 4,151,946

[45] May 1, 1979

[54] DISPENSER CONTAINER

[75] Inventors: Arnold H. Schmidt, Woodridge; John N. Thomas, Orland Park, both of Ill.

[73] Assignee: The Lamson & Sessions Co., Brooklyn, Ohio

[21] Appl. No.: 759,828

[22] Filed: Jan. 17, 1977

[51] Int. Cl.[2] ..... B65D 5/72

[52] U.S. Cl. ..... 229/17 R; 229/7 R; 206/621; 229/33

[58] Field of Search ..... 229/17 R, 7 R, 33, 36, 229/17 SC; 206/621

[56] References Cited

U.S. PATENT DOCUMENTS

| | | | |
|---|---|---|---|
| 1,256,437 | 2/1918 | Careaga | 229/17 R |
| 2,104,195 | 1/1938 | Groeling | 229/33 |
| 2,319,018 | 5/1943 | Ullman | 229/33 |
| 2,585,056 | 2/1952 | Tierney | 229/7 R |
| 3,478,948 | 11/1969 | Dornbush | 229/17 SC |
| 3,747,833 | 7/1973 | Robinson | 229/17 R |

*Primary Examiner*—William Price
*Assistant Examiner*—Joseph Man-Fu Moy

[57] ABSTRACT

An improved container is both stackable and capable of forming a hopper to facilitate dispensing of articles therefrom. To enable the container to withstand relatively large loads when it is placed in a stack, the container is formed with overfolded sidewall panels. The top, bottom and end walls are single paneled for more economic fabrication. A tear strip is formed across the top panel adjacent one end of the container to provide access to the interior of the container and to release a front end closure for outward pivoting movement about a fold line to form the hopper.

17 Claims, 3 Drawing Figures

DISPENSER CONTAINER

BACKGROUND OF THE INVENTION

The present invention relates to a container and more particularly to a stackable dispenser container.

Cartons of nuts and bolts and similar articles are commonly stacked during shipping and subsequent storage. The lower cartons in a stack must be capable of withstanding a relatively large weight without collapsing.

When articles, such as nuts and bolts, are to be withdrawn from a shipping carton, the shipping carton should open in such a manner that the contents are readily accessible. For most purposes, these cartons remain open until the contents are exhausted.

In a prior U.S. Pat. No. 3,747,833, there is shown a carton which requires considerable gluing of relatively large surface areas to assemble. The present structure requires gluing over a relatively small area, and in preferred embodiments, the area of adhesion is removed along with the tear strip, and the box retains its form and rigidity through tabs inserted in appropriate slots. While the devices of the present invention may be stacked in the filled condition for dispensing, they are more conveniently supported in a single layer when in use upon metal racks with sloping shelves without the boxes being superimposed one upon the other. Prior structures provide restricted access to the interior whereas preferred embodiments of the present devices are improved in this regard. Moreover, filling of the containers is able to be accomplished with all gluing previously completed. Gluing of flaps after filling is inconvenient, it being more efficiently done in conjunction with the blanking operation.

BRIEF STATEMENT OF THE INVENTION

To the accomplishment of the provision of improved access to the interior of the container for removal of articles therefrom, when the container is opened, there is simultaneously removed from the top an indented cut out which enlarges the access opening more than that provided by merely extending the hopper to its fully open condition.

The containers of the present invention require no further gluing at the time of filling. This is provided for in that the blanks of this invention may be formed into a flat cardboard sleeve at the blanking cite and all gluing accomplished at that point. The container is erectable at a remote cite for filling by parallelogrammatic movement of the top relative to the bottom together with the end closures. One of the end closures includes a glue strip which is adhered to the top. Filling of the container is achieved through a side. The other side of the container is closed by interlocking tabs engaged in suitable slits and serves as a temporary bottom for filling the container with articles, e.g. fasteners. Thereafter, the remaining side is overfolded and the attached interlocking tabs inserted into suitable slits to complete the closure.

Opening of the container involves freeing a hopper-forming end closure by removal of a portion of the top and the adhered glue tab. To this end, specific embodiments provide a tear strip across the front end of the top. The width of the tear strip across the top panel is preferably dimensioned to give improved hand access into the container, i.e., more than would otherwise be provided between the normal front marginal edge of the top and the top edge of the hopper in the opened condition.

The invention also provides a cardboard blank for forming the foregoing container.

BRIEF DESCRIPTION OF THE DRAWINGS

The invention may be better understood by having reference to the annexed drawings wherein.

DETAILED DESCRIPTION OF THE DRAWINGS

Figure 2:
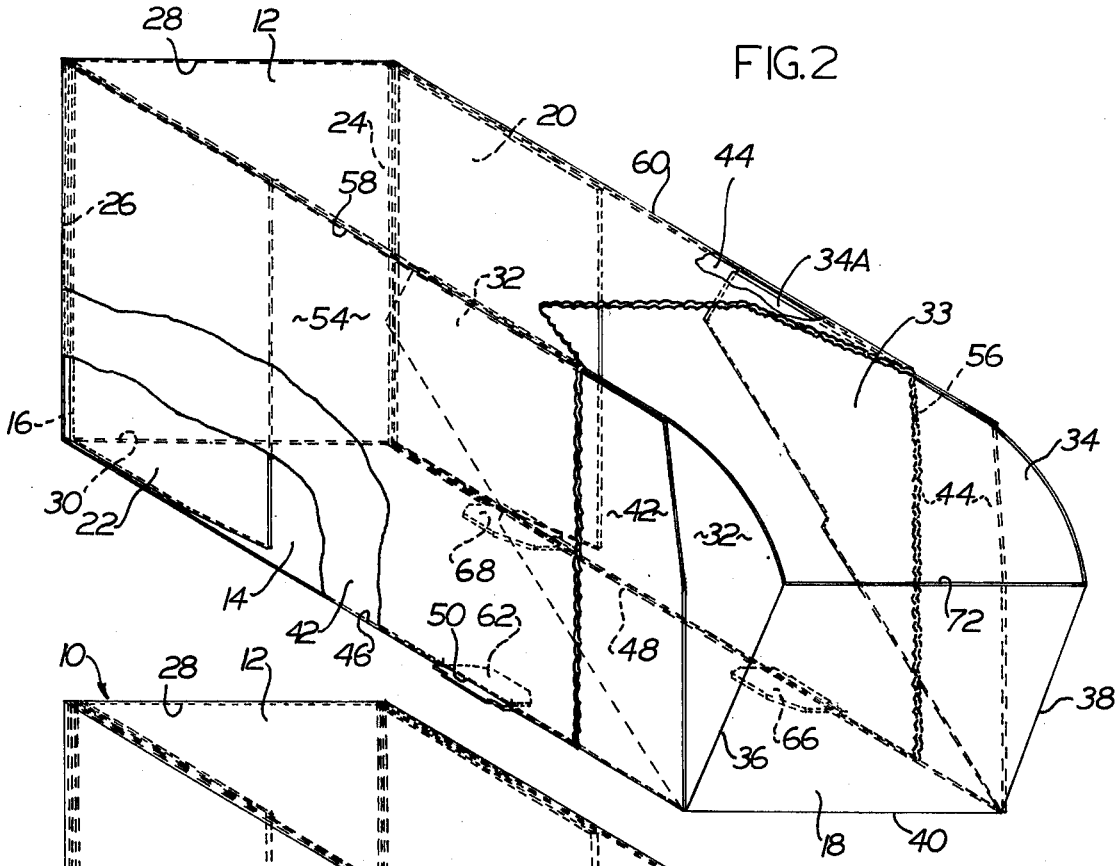
FIG. 2 is a partially broken away illustration of the stackable dispenser container of FIG. 1 in an open condition in which the front end closure of the container is moved outwardly to form a dispenser hopper.
Figure 1:
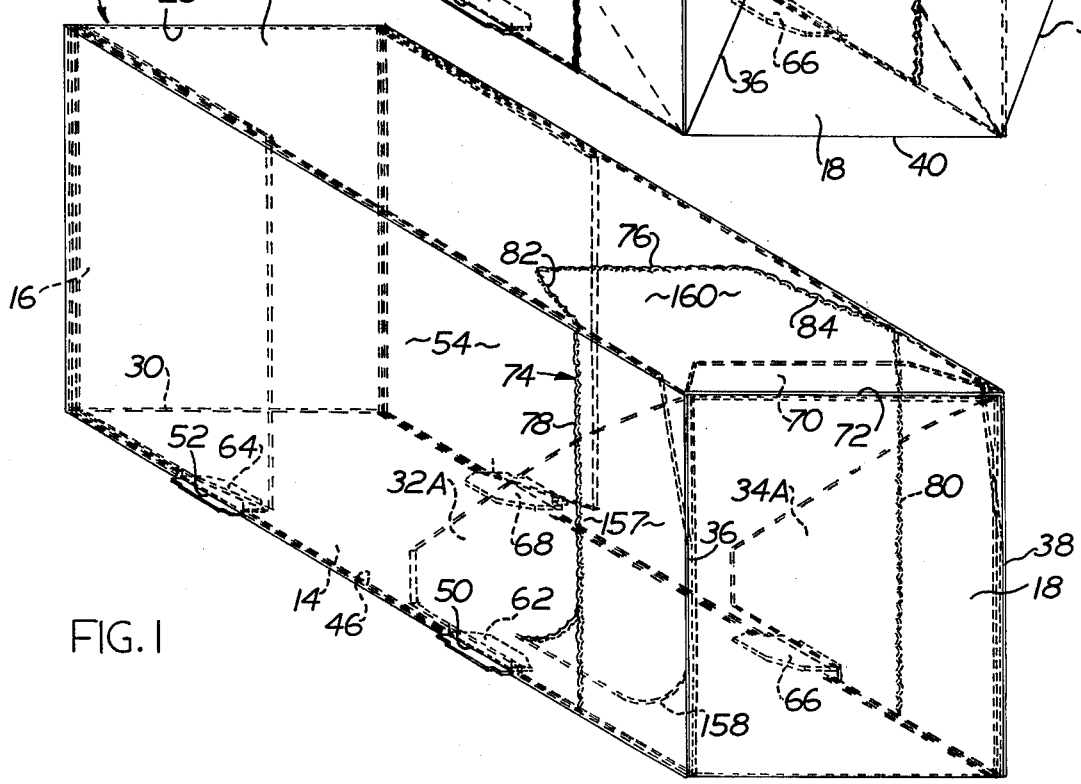
FIG. 1 is a perspective illustration of a preferred stackable dispenser container constructed in accordance with the present invention, the container being shown in a closed condition.

A stackable dispenser container or carton 10 constructed in accordance with the present invention and illustrative of the best mode of practicing the invention is illustrated in FIG. 1 in a closed or shipping or storage condition. FIG. 2 shows the same box illustrated in FIG. 1 in the open or article dispensing condition. The container is provided with a top panel 12 and a bottom panel 14, both of rectilinear configuration and disposed in parallel relationship. End closure panels 16 and 18 are provided, and each provided with side flaps inwardly foldable along vertical fold lines. Thus, end closure 16 at the rear of the container is provided with a first stiffener flap 20 and a second stiffener 22, each folded inwardly of the container and at substantially right angles to the rear end closure 16 along fold lines 24 and 26, respectively. The rear end closure 16 is in a right angular relationship with the top 12 and the bottom 14 and integrally connected to each of them along fold lines 28 and 30, respectively. The front end closure 18 is provided with a first hopper side flap 32 and a second hopper side flap 34 each disposed at a right angle to the front end closure 18 by folding along fold lines 36 and 38. As will be hereinafter more particularly described with respect to the hopper side flaps 32 and 34, these have a configuration to enable the front end closure 18 to be moved outwardly by rotation about the hinge line 40 a predetermined extent, e.g. about 45°, at which point an extension **32*a* of the first hopper side flap 32 and an equivalent extension 34*a* of the opposite hopper side flap 34 abut or engage the top 12 to prevent further opening of the front end closure 18**.

The side walls of the container are preferably of double thickness for strenghtening the containers. Thus, there are provided a first inner sidewall 42 and a second inner sidewall 44 each of which is integral with the bottom panel 14 along parallel fold lines 46 and 48, respectively. The fold lines 46 and 48 are discontinuous in portions where tab receiving slots are cut, for example slots 50 and 52 on fold line 46. In overlying relation with the inner side panels 42 and 44, there are provided outer side panels 54 and 56 which are integral with the top 12 along fold lines 58 and 60, respectively. Outer side panel 54 (which is partially cut away in FIG. 2) is provided along its free marginal edge with interlocking tabs such as tab 62 for insertion through tab slot 50, and a tab 64 for insertion through slot 52. In like manner, outer panel 56 is provided with interlocking tabs 66 and 68 for insertion through corresponding tab slots 150 and 152 (FIG. 3) on the fold line 48. The stiffener flaps 20 and 22 and the hopper side flaps 32 and 34 may be disposed inwardly of the inner side panels 42 and 44, although they are preferably disposed between the inner and outer side panels to prevent interference therewith in removal of articles from the container. The provision of the fully overlapping double sidewalls makes the containers relatively strong and enables them to withstand relatively heavy stacking loads. The sidewalls are preferably formed of inner and outer panels with the free marginal edges of the outer panels having interlocking tabs which rest on the inner surface of the bottom panel and locate the free marginal edges of said outer panels substantially in the plane of the outer surface of the bottom panel. In the interest of economy of manufacture, the top and bottom walls 12 and 14 of the container are single layered as are the end closures 16 and 18.

Figure 3:
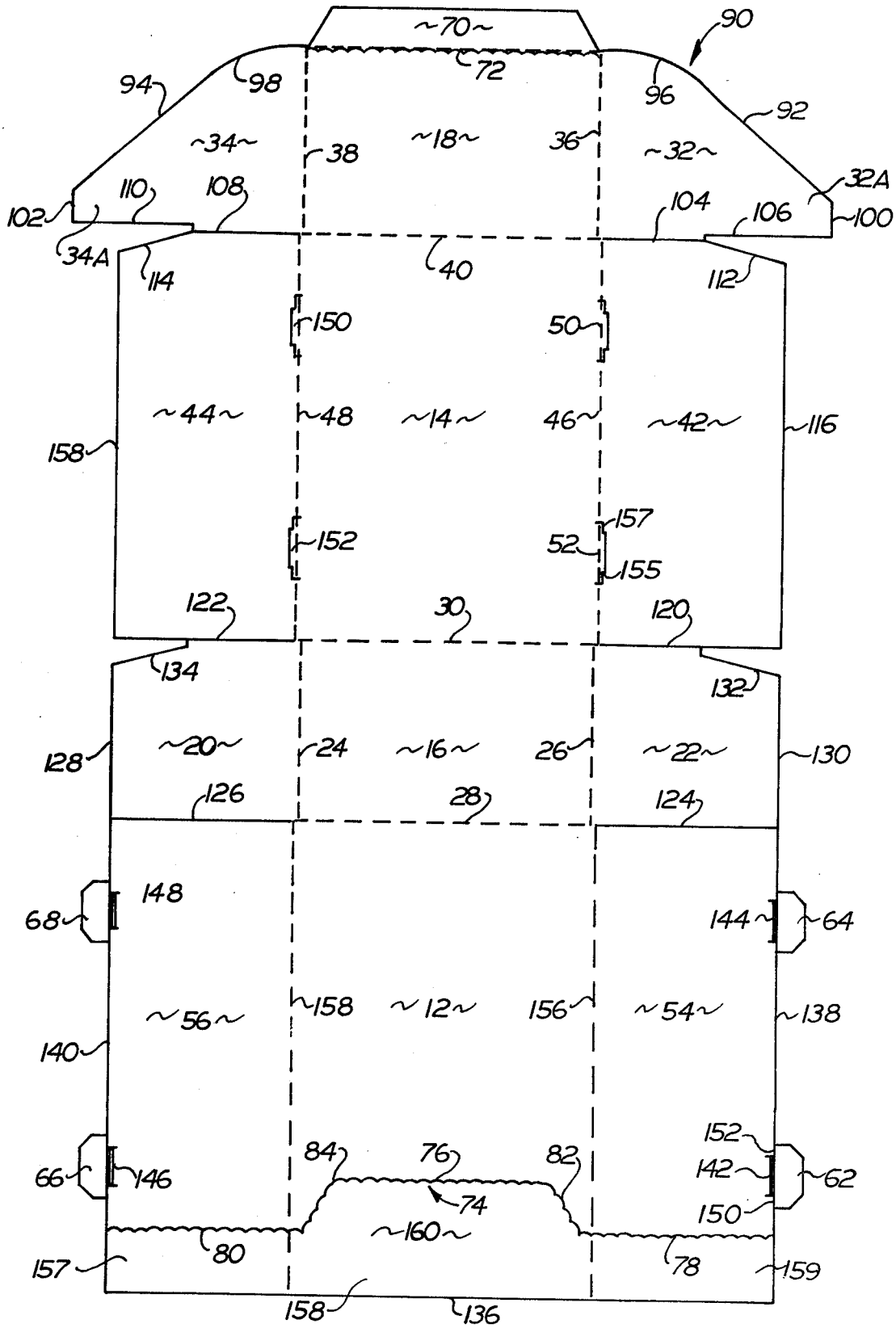
FIG. 3 is a plan view of a corrugated cardboard blank for forming the stackable dispenser container of FIGS. 1 and 2.

The container is held together by the interlocking tabs 62, 64, 66 and 68, and by means of a glue tab 70 which is secured to the upper marginal edge 72 of the front end closure 18 along a perforated fold line 72 (FIG. 3). The glue tab 70 is folded to lie in contiguous relation with the top 12 and is adhered thereto by any suitable adhesive. The free upper marginal edge 72 of the hopper end closure 18 is developed when the glue tab 70 is severed therefrom in opening the container. The employment of interlocking tabs as above described enables side filling of the container without subsequent gluing.

To open the container, and to provide for convenient access to the interior thereof, there is provided a perforated tear line 74 which traverses seriatim the outer side panel 54, the top panel 12, and the outer side panel 56. The tear line 74 is adjacent the hopper 33 at the front end of the container 10 and is continuous from the free edge of the outer panel 54 adjacent the bottom of the container, across the fold line 58 into the top 12 of the container, across the top 12 and the fold line 60, and then across the outer panel 56 to its lower free marginal edge adjacent the bottom 14. The a preferred embodiment, as shown in FIGS. 1–3, the tear line 74 as it traverses the top 12 is at a greater distance from the end closure 18 than are the tear line portions 78 and 80 traversing the side panels 54 and 56, respectively. Thus, a tear line portion 76 parallel to the fold line 72 is disposed a greater distance toward the rear end of the container from the fold line 72 than are the portions 78 and 80 from the fold lines 36 and 38, respectively. For most purposes, the extension toward the rear may have a width of from 1.5 to 2 times the width of the tear strip in the outer sidewalls. To accommodate the recess of portion 72 and preserve continuity of the tear line, the portion 76 of the tear line 74 is joined to the portions 78 and 80 by diverging intersecting portions 82 and 84. The tear line configuration above described is preferred for providing better access to the interior of te container. When the outer side panel 54 is torn along the tear line portion 78 as illustrated in dotted lines in FIG. 1, the forward rectangular end portion of the side panel 54 is removed, a generally trapezoidal section of the top panel 12 is removed, and the forward rectangular end portion of the outer side panel 56 is also removed. In this operation, the glue tab 70 being adhered to the underside of the forward portion of the top panel 12 and secured to the front end closure 18 along a tear line 72 is also removed.

At this point, the front end closure 18 may be grasped by its now free edge 72 and rotated forwardly about the hinge line 40 until the extensions 32a and 34a of the hopper side panels or flaps 32 and 34, respectively, come into abutting relation with the top 12. The resulting hopper configuration with the trapezoidal section of the top 12 removed enables better access to the interior of the container and easy removal of the contents thereof.

FIG. 3 shows the configuration of a corrugated cardboard blank from which the containers of the present invention are conveniently fabricated. The generally rectangular corrugated cardboard blank 90 is divided into a plurality of panels by suitably disposed slits and fold lines. For convenience, the slits are illustrated as solid lines and the fold lines as dashed lines, and these lines are numbered where possible as the corresponding lines in FIGS. 1 and 2. The panels and tabs are numbered as in FIGS. 1 and 2.

In the developed form shown in FIG. 3, the bottom panel 14 is defined by longitudinally spaced fold lines 40 and 30 and laterally disposed fold lines 46 and 48. The front end closure 18, then, is integral with the bottom panel 14 along the fold line 40 and when erected shares the fold line 40 with the bottom panel 14 as a common marginal edge. The lateral marginal edges 38 and 36 of the end closure panel 18 are also fold lines shared in common with the hopper side flaps 34 and 32, respectively. The remaining marginal edge of the front end panel 18 is a dual purpose edge being at once a fold line 72 for the glue tab 70, and a perforated tear line which will enable separation of the glue tab 70 and the creation of the marginal edge 72 as a free edge.

As indicated above, the hopper side panels 32 and 34 are provided with lateral extensions **32*a* and 34*a*, respectively, which extend bilaterally beyond the general rectangular configuration of the blank 90. The hopper side panels 32 and 34 are of generally right triangular shape. The inner marginal edges thereof are in common with the fold lines 38 and 36 of the end closure panel 18. The outer free marginal edges 92 and 94 correspond generally to the hypotenuse of the right triangular configuration, and in a preferred embodiment as illustrated in FIG. 3, have arcuate portions 96 and 98, respectively. The lateral marginal edges 100 and 102, respectively, are truncated portions of the triangles. The remaining marginal edges 104 and 108 of the hopper side panels 32 and 34, respectively, are slit lines where they abut the inner side panels 42 and 44, respectively, and are also conveniently provided with a recessed extension 106 and 110, respectively, for intersection with truncated edges 100 and 102, respectively. The cut recessed disposition of the lines 106 and 110 provides clearance for the tabs 62 and 66, respectively. As indicated, the inner side panels 42 and 44 are integral with te bottom panel 14 along gold lines 46 and 48**.

Hopper side panels 32 and 34 are best inserted between the inner side panels 42 and 44, respectively, and the overfolded outer panels 54 and 56 to keep them in place during filling and out of the way when the contents are being withdrawn.

The upper marginal edges of the inner side panels 42 and 44 are defined by the slit lines 104 and 108, and the slightly raked edges 112 and 114. The lateral marginal edges 116 and 118 when the container is assembled underlie and abut the top 12. The lower marginal edges (as viewed in FIG. 3) of the inner side panels 42 and 44 are defined by the slit lines 120 and 122.

Rear end panel 16 is of rectangular configuration and is defined entirely by fold lines 30, in common with bottom panel 14, lateral fold lines 24 and 26, and lower fold line 28. The lateral edges 24 and 26 of panel 16 are in common with the stiffener flaps 20 and 22. It should be noted that the fold lines 24 and 26 are not continuous with the fold lines 46 and 48, the former being slightly displaced inwardly to position the stiffener flaps 20 and 22 inwardly of the outer side panels 54 and 56 when the box is erected, preferably between the inner side panels 42 and 44, and, the outer side panels 54 and 56.

The stiffener flaps 20 and 22 are defined by the upper slit lines 122 and 120, respectively, and the lower slit lines 124 and 126. The free lateral marginal edges 128 and 130 complete the generally rectangular configurations of the stiffener flaps 20 and 22. For convenience, the upper marginal edges 120 and 122 are raked slightly as at 132 and 134 to accommodate the interlocking tabs 64 and 68 when the container is erected.

In the same manner that the fold lines 24 and 26 of the rear end closure panel 16 are displaced slightly inwardly of the fold lines 48 and 46, respectively, so also are the fold lines 38 and 36 of the front end closure panel 18 slightly displaced inwardly to dispose the hopper side flaps 32 and 34 inwardly of the outer side panels 54 and 56, when the box is erected, preferably between the inner side panels 42 and 44 and the outer side panels 54 and 56, respectively.

The top panel 12 is defined on three sides by fold lines 58, 28 and 60, and by the free marginal edge 136. The outer side panels 54 and 56 are defined along their upper marginal edges by the slit lines 124 and 126, respectively, and the bottom free marginal edges 136 of the blank 90. The lateral free marginal edges 138 and 140 complete the generally rectangular configuration of the outer side panels 54 and 56. At intervals along the outer free marginal edges 138 and 140, there are provided interlocking tabs 62, 64, 66, and 68. These are conveniently joined two each to the respective outer side panels 54 and 56 at slightly inwardly recessed fold lines 142, 144, 146 and 148, respectively. The purpose for recessing the fold lines of the tabs 62, 64, 66 and 68 is to position the interlocking tabs against the inner side of the bottom 14, and allow the free marginal edges 138 and 140 to be disposed in the erected condition substantially in the plane of the outer surface of the bottom wall or panel 14. Suitable short slit segments 150 and 152 for example in tab 62 enable folding along the inwardly recessed fold line 166. The remaining tabs 64, 66 and 68 are similarly configured and slit.

The perforation line 74 with its segments 76, 78, 80, 82 and 84 is shown traversing what will become the front portions of the outer side panels 54 and 56, and the top 12. The tear line is formed from a plurality of disconnected crescent shaped slits which are disposed in linear array with a leading end portion of one of the perforation slits overlapping or extending beyond the trailing end portion of the next perforation, as is well known (see U.S. Pat. No. 3,747,833).

For convenience, following the blanking operation, the obverse side of the forward part of the top panel adjacent the marginal edge 136 (FIG. 3) is adhered to the glue tab 70 to form a flat double thickness box sleeve for shipping and storage. The container is then readily erected from the resulting sleeve by positioning the container on its bottom panel 14 and moving the end closures 16 and 18 in parallelogrammatic movement to an upright position. The inner side panel 44 is rotated about its fold line 46 and then the first stiffener flap 20 and the hopper side flap 34 are then folded along the fold lines 26 and 38, respectively. To retain the stiffener flap 20 and the hopper side flap 34 in position, the outer side flap 56 is then overfolded downwardly along its fold line 60, and the tabs 66 and 68 inserted in the precut tab slots 150 and 152. The insertion of the tabs 66 and 68 necessitates their being folded along the fold lines 146 and 148. Note that in the preferred embodiments of FIGS. 1–3, the tab slots 50, 52, 152 and 150 are displaced from the fold lines 48 and 46 slightly to accommodate the tabs 62, 64, 66 and 68 in position inwardly of and against the bottom panel 14. Shoulders 155 and 157 in slot 156 for example, aid in locking tab 64 into the interlocked position. The remaining slots are similarly shouldered for the same purpose.

At this point in construction of the container the panels 42 and 54, the stiffener flap 22 and hopper side flap 32 are in an open condition so that articles may be placed within the container while it is resting on the outer side panel 56 as a temporary bottom. To close the container about the articles, the inner side flap 42 is folded along its fold line 48 and then the stiffener flap 22 and the hopper side flap 32 are folded along their respective fold lines 24 and 36. To retain the flaps 22 and 32, the outer side panel 54 is then over folded along its fold line 58 over the flaps 22 and 32, and the tabs 62 and 64, being first folded along their respective fold lines 142 and 144, are inserted in shouldered slots 154 and 156, respectively, to complete the closure of the container. With the interlock arrangement for the tabs 62, 64, 66 and 68, the container remains stably closed without further gluing.

To open the container and expose the contents, the front portions 157, 160 and 159 of the outer side panel 56, the top 12, and the outer side panel 54 respectively are removed by tearing along the perforated tear line sections 78, 82, 76, 84 and 80, (or in the reverse order) which simultaneously removes the glue tab 70 to which it is adhered, and which is also simultaneously torn along its perforated fold line 72. The removal of this "tear strip" (FIG. 3) frees the front end closure 18 for angular rotation about the fold line 40 and formation of the generally triangular shaped hopper 33 (FIG. 2). The enlarged hand hole exposed by removal of an inwardly extending trapezoidal portion 160 of the top 12 facilitates removal of articles from the container.

As can be seen from the foregoing, there has been provided a stackable dispensing container 10 having means for forming a hopper shaped dispenser opening 33 in one end, the size of which opening has been enhanced by removal of a portion 160 of the adjacent top wall 12 of the container. The container 10 is desirably provided from the blanking operation as a sleeve erectable as a carton by parallelogrammatic movement of the top 12 relative to the bottom 14 and the end walls 16 and 18, one of which (16) is integral with the top and bottom walls along fold lines 28 and 30 and the other of which is integral with the bottom along a fold line 40, and through the agency of a glue tab 70 adhered to the top 12 along a perforated fold line 72. Erection is completed by infolding of flaps 20, 22, 32, and 34 and sidewalls 42, 44, 54, and 56. The sidewalls 54 and 56 include interlocking tabs 62, 64, 66 and 68 to retain the final assembly even though the glue tab 70 is later removed in opening the container. The provision of the interlocking tabs in this assembly enables side filling of the container with dispensable articles and secure closure thereof without additional gluing. A tear strip 158 is provided for opening the container and release of the hopper forming end closure 18 with the simultaneous creation of an enlarged hand access opening by removal of the front portion 160 of the top 12 and the glue strip 70 adhered thereto.

What is claimed is:

1. A dispenser container of rectangular configuration when closed and including hopper forming means to facilitate dispensing articles therefrom when open, said container comprising top and bottom walls, front and rear end closures extending between said top and bottom walls, and a pair of side walls cooperating with said top and bottom walls and said end closures to define an article receiving chamber, each of said side walls including an inner panel and an outer panel in overlapped relation, said rear end closure including first and second stiffener flaps in overlapped relation with the respective adjacent inner panel portions, said front end closure including laterally disposed first and second hopper flaps extending from opposite marginal edges of said front end closure and in overlapped relation with the respective adjacent inner panel portions at the front end of said container, the upper marginal edges of said hopper flaps each sloping from locations adjacent said bottom wall upwardly away from said rear end closure and toward said top wall, said hopper flaps each extending inwardly of said container toward said rear end closure a distance greater than the distance between said top and bottom walls, said front end closure being hingedly connected at its bottom edge to said bottom wall at the front marginal edge thereof, and said front end closure including a glue tab which is separable from said front end closure along the top marginal edge of said front end closure, said front end closure being movable outwardly about said hinge to an open position when said glue tab is separated from said front end closure, said front end closure extending at an obtuse angle to said bottom wall when said front end closure is in said open position, at least a portion of each of said sloping marginal edges of said hopper flaps abutting said top wall to prevent further outward movement of said front end closure when said front end closure is in said open position to provide a hopper, said glue tab being adhered to said top wall at the front end thereof, perforation means traversing the top wall adjacent the front end of said container at a location inwardly of and space apart from said glue tab to provide a tear strip across said top wall for removing the glue tab and a portion of said top wall from the container and for releasing the top marginal edge of the front end closure to enable said front end closure to move to said open position, said perforation means extending across at least one of said outer panels to provide a portion of said outer panel which is also removed from the container along with said glue tab and said portion of said top wall upon opening said container.

2. A container in accordance with claim 1 wherein the inner panels of said side walls are each joined to said bottom wall along a fold line, the edges of said inner panels being dimensioned relative to said bottom wall for abutting relation with said top wall.

3. A container in accordance with claim 2 wherein the outer panels of said side walls are each joined to said top wall along a fold line.

4. A container in accordance with claim 3 wherein slots are provided between the inner panels of said side walls and said bottom wall and correspondingly positioned tabs are provided along free marginal edges of the outer panels of said side walls for insertion in said slots to hold the outer panels of said side walls against movement relative to the inner panels of said side walls.

5. A container in accordance with claim 4 wherein said stiffener flaps are each provided with a cut out relief portion in the marginal edge thereof adjacent said bottom wall for clearing a tab when the tab is inserted through its corresponding slot.

6. A container in accordance with claim 4 wherein said hopper flaps are each provided with a cut out relief portion in the marginal edge thereof adjacent the bottom for clearing a tab when the tab is inserted through its corresponding slot.

7. A dispenser container in accordance with claim 1 wherein said first and second hopper flaps are disposed between respective one of said inner panel portions and the outer panels.

8. A container in accordance with claim 1 in which the perforation means extends across both of said outer panels.

9. A container in accordance with claim 8 in which said perforation means includes a series of spaced apart crescent shaped slits extending through the outer panels of said side walls and across said top wall, said series of slits at least partially defining a tear line which extends from a free marginal edge of the outer panel of one side wall to the top wall across the top wall, and from the top wall to the free marginal edge of the outer panel of the other one of said side walls.

10. A container in accordance with claim 9 in which at least a portion of said perforation means extending across the top wall is disposed closer to said rear end closure than portions of said perforation means extending across each of said outer panels.

11. A container having a rectangular configuration when closed, said container including hopper forming means at one openable end of said container to facilitate the dispensing articles from said container, said container comprising in combination; top and bottom walls, a front hopper-forming end closure and a rear end closure each extending between said top and bottom walls, and a pair of side walls cooperating with said top and bottom walls and said front and rear end closures to define an article receiving chamber, said side walls being formed of overlapped side panels to provide an inner side panel and an outer side panel on each side of the container the outer side panels being joined to the top wall along fold lines, respectively, said front hopper-forming end closure having flaps extending from opposite marginal edges and in overlapped relation with the respective adjacent side walls, said front hopper-forming end closure being movable about a fold line common to said front hopper-forming end closure and said bottom wall to form a hopper having an upwardly facing opening through which articles can be removed from said container, said top wall including means for defining a removable portion of said top wall adjacent the front hopper-forming end closure including a tear strip, said tear strip having portions traversing at least one of the outer side panels from the bottom marginal edge to the top marginal edge and across at least one of said fold lines, said removable portion being separable from said container and from the remainder of said top wall and said at least one outer side panel to at least partially define in said top wall an opening which forms a continuation of the upwardly facing opening formed by movement of said hopper-forming end closure to facilitate access to the interior of the container and to provide a portion of said at least one outer side panel which is removable from said container along with said removable portion of said top wall upon opening said container.

12. A dispenser container in accordance with claim 11 wherein the width of the tear strip across the top wall is greater than the width of the tear strip across each of said outer side panels

13. A dispenser container in accordance with claim 11 wherein said front end closure includes along its top marginal edge a separable glue tab adhered to the underside of said removable portion of said top, said glue tab being removable simultaneously with said removable portion.

14. A dispenser container in accordance with claim 13 wherein said glue tab is coextensive with the top marginal edge of said front end closure.

15. A dispenser container in accordance with claim 14 wherein said glue tab is joined to said top marginal edge of said front end closure along a perforated tear and fold line.

16. A dispenser container sleeve erectable by parallelogrammatic movement to a rectangular prismatic configuration and having when so erected one closable side wall to enable filling of the container through the side when partially erected and having hopper forming means for dispensing articles therefrom, said container having top and bottom walls, front end and rear end closures extending between said top and bottom walls, and a pair of side walls cooperating with said top and bottom walls and said end closures to define an article receiving chamber, each of said side walls including an inner panel and an outer panel in overlapped relation, each of said inner side panels being integral respectively with opposite sides of said bottom wall along a fold line, said fold lines each including spaced tab receiving slits and each of said outer panels being integral respectively with opposite sides of said top wall along a fold line, the free marginal edges of said outer panels opposite said fold line having interlocking tabs projecting therefrom along spaced fold lines for folding therealong and insertion of said interlocking tabs in said spaced tab receiving slits to close said sides, respectively, said rear end closure including first and second stiffener flaps in overlapped relation with the respective adjacent inner panel portions, said front end closure including laterally disposed first and second hopper flaps extending from opposite marginal edges of said front end closure and in overlapped relation with the respective adjacent inner panel portions at the front end of said container, the upper marginal edges of said hopper flaps each sloping from adjacent the bottom upwardly toward said front end and said top wall, said hopper flaps each extending inwardly of said container toward said rear end closure a distance greater than the distance between said top and bottom walls, said front end closure being hingedly connected at its bottom edge to said bottom wall at the front marginal edge thereof, and said front end closure including a separable glue tab folded along a fold line at its top marginal edge and adhered to said top wall to form said sleeve and separable by tearing along perforations in said last named fold line, whereby when said glue tab is separated, said front end closure is movable about said hinge to an open position at an obtuse angle to said bottom and at least a portion of each of said sloping marginal edges of said hopper flaps abuts said top wall to form a hopper, and to prevent further opening of said front end closure, perforation means traversing at least one of said outer panels from the free marginal edge thereof and the top wall adjacent the front end of said container and inwardly of said glue tab to provide a tear strip across the top wall for removing the glue tab along its perforated fold line and a portion of the top from the container and releasing the top marginal edge of the front end closure to enable opening of said hopper, and to provide a portion of said outer panel which is also removed from the container along with said glue tab and said portion of the top wall upon opening said container, said container being otherwise maintained in its erected condition by said interlocking tabs.

17. A dispenser container in accordance with claim 16 wherein the free upper marginal edge of the inner side panels abut the top wall, and the free lower marginal edges of said outer side panels lie substantially in the plane of the exterior surface of said bottom wall.

* * * * *